United States Patent [19]

Nigrelli, Sr.

[11] Patent Number: 4,678,456

[45] Date of Patent: Jul. 7, 1987

[54] CARTON OPENING APPARATUS

[76] Inventor: Biagio Nigrelli, Sr., 14829 Moraine Rd., Kiel, Wis. 53042

[21] Appl. No.: 843,016

[22] Filed: Mar. 24, 1986

[51] Int. Cl.[4] ..... B31B 1/78

[52] U.S. Cl. ..... 493/309; 493/319; 493/409

[58] Field of Search ..... 493/309, 310, 318, 319, 493/123, 124, 409

[56] References Cited

U.S. PATENT DOCUMENTS

| | | | |
|---|---|---|---|
| 2,750,856 | 6/1956 | Ferguson et al. | 493/309 |
| 2,906,392 | 9/1959 | Galloway | 493/309 |
| 2,947,229 | 8/1960 | Caresio | 493/310 |
| 3,040,034 | 6/1962 | Galloway | 493/319 |
| 3,122,071 | 2/1964 | Vogel | 493/310 |
| 3,174,259 | 3/1965 | Jones et al. | 493/309 |
| 4,057,008 | 11/1977 | Hughes | 493/310 |

FOREIGN PATENT DOCUMENTS

| | | | |
|---|---|---|---|
| 181807 | 12/1902 | Sweden | 493/309 |

*Primary Examiner*—Frederick R. Schmidt

*Assistant Examiner*—William E. Terrell

*Attorney, Agent, or Firm*—Fuller, Puerner & Hohenfeldt

[57] ABSTRACT

A carton unfolding machine reliably unfolds folded carton blanks. The blanks are continuously propelled horizontally by stripper fingers along a first support with the flaps extending transversely to the direction of motion. Blocks in the path of the flaps raise the trailing flaps slightly relative to the plane of the blank sides and leading flaps. The blanks pass spring plates that enter slits between the trailing and leading upper flaps to support the trailing upper flaps. The first support terminates under the spring plates, so that the blank is supported only at the trailing upper flaps by the spring plates and by the stripper fingers. The unsupported blank leading edge tips due to gravity, thus slightly unfolding the blank. Continued motion by the stripper fingers pushes the blank out of contact with the second support, and the leading edge falls to a carrier. The stripper fingers continues to push the sloped and partially opened blank against the slower moving carrier, thereby completely unfolding the blank.

10 Claims, 10 Drawing Figures

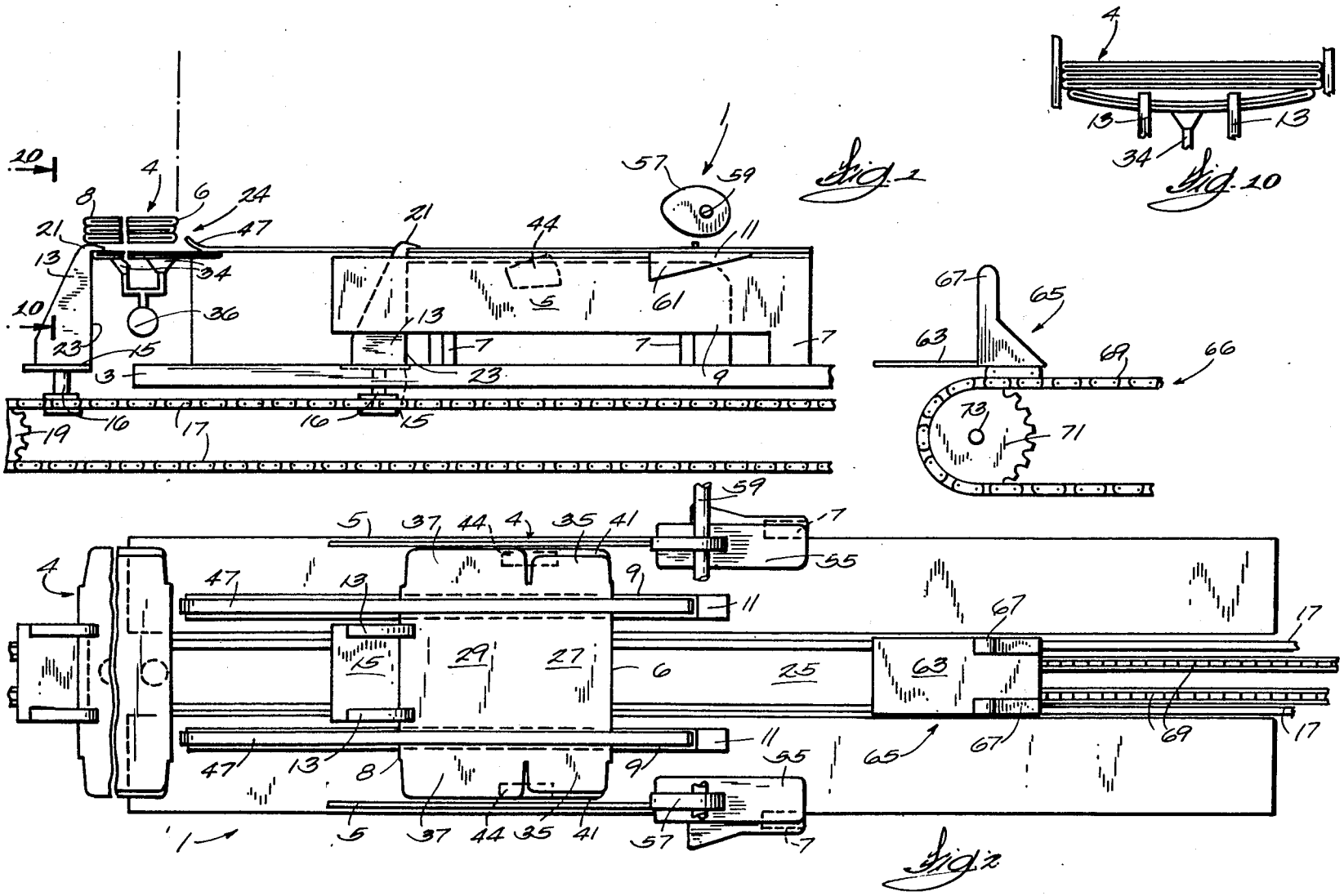

CARTON OPENING APPARATUS

BACKGROUND OF THE INVENTION

1. Field of the Invention

This invention pertains to container handling apparatus, and more particularly to apparatus for opening folded carton blanks prior to inserting desired articles into the cartons.

2. Description of the Prior Art

Machinery for automatically loading open side cartons with complements of upright articles is well known. The cartons to be loaded are usually supplied to the loading machinery as folded blanks. As a preliminary step to the loading process, the carton blanks must be unfolded.

Normally the blanks are supplied to the unfolding equipment from a storage hopper or other source in which the blanks are laid horizontally in a vertical stack. The blanks are removed one at a time from the supply stack for unfolding and transporting to the article loading station. Exemplary machinery for unfolding blanks and for side loading the open side cartons is disclosed in copending U.S. patent application Ser. No. 602,527. The unfolding machinery of patent application Ser. No. 602,527, while completely satisfactory in many respects, does not possess all the advantages and benefits disclosed herein.

SUMMARY OF THE INVENTION

In accordance with the present invention, machinery is provided for opening unfolding side loading carton blanks in an inexpensive reliable manner. This is accomplished by apparatus that includes hooked stripper fingers for continuously propelling individual folded blanks along an unfolding path from a supply section to an unfolding section.

The carton blanks are folded into an upper layer and a lower layer, each layer consisting of two carton sides of unequal length together with a closure flap on both ends of each carton side. The blanks are oriented with the flaps facing transversely to the direction of motion of the blanks along the unfolding path.

To support the blanks along the initial section of the unfolding path, the carton opening apparatus includes a pair of laterally spaced longitudinally extending support plates that receive the blanks from the supply stack and along which the stripper fingers push the blanks. The plates are spaced transversely relative to the direction of blank motion such that the four flaps on each end of the blank overhang the plates. A stationary assist block is located outboard of each support plate. The upper surfaces of the assist blocks project slightly above the plates and into the path of the carton flaps. As the stripper fingers push a blank past the assist blocks, the flaps are raised slightly relative to the plane of the folded carton sides. To restrain the carton sides from lifting off the support plates due to the stiffness of the flap fold lines, a pair of vertical guides are utilized to press the blank sides onto the top surfaces of the support plates. When the blank leading flaps have passed the assist blocks, they return to a planar relationship with the carton sides, while the trailing flaps on each end remain slightly raised by the assist blocks. As a result, a vertical gap is created in the slits between the leading and trailing flaps.

The present invention includes cam controlled spring plates that are deflectable to enter the vertical gaps in the slits between the leading and trailing upper layer flaps on each end of the blank such that the upper and lower leading flaps pass under the spring plates but only the lower layer trailing flaps pass under the spring plates. The spring plates also lift the upper flap and are controlled to pass over the lower flaps. The upper layer trailing flaps pass over the spring plates. The spaced vertical support plates terminate in the region of the spring plates, so that they do not provide vertical support to the blank sides after the spring plates have separated the upper and lower trailing flaps; the blank is supported only by the spring plates under the upper layer trailing flaps in conjunction with hooks on the stripper fingers. Consequently, as the stripper fingers continue to propel the blank downstream past the spring plates, the leading edge of the blank tends to tip because of gravity, but also is mechanically controlled. A timed finger or cam motion may be employed. The tipping motion of the leading edge while the trailing flaps are supported by the spring plates and hooks tends to open the blank slightly. Continued motion by the stripper fingers causes the leading edge to fall until it contacts the base of a carrier having upstanding posts. The carrier is located with respect to the spring plates such that the blank leading edge contacts the base of the posts just as the trailing edge passes beyond the spring plates. At that point, the leading edge of the partially unfolded blank is restrained in the corner formed by the carrier base and upstanding posts; the lower trailing flaps rest on the spring plates; the trailing edge of the blank remains within the hooks of the stripper fingers; the blank is slopped downward forwardly; and the blank is slightly unfolded. Continued forward motion by the stripper fingers relative to the stationary carrier causes the lower trailing flaps to loose contact with the spring plates so that the trailing edge is in contact only with the stripper fingers. From that point, further forward motion by the stripper fingers forces the blank into a completely opened condition with the flaps extending laterally and coplanar with the corresponding carton sides. After the blank is completely unfolded, further motion by the stripper fingers also forces the carrier to move in unison with the unfolded carton therebetween to the next station in the carton side loading process.

Other objects and advantages of the invention will become apparent to those skilled in the art from the disclosure.

BRIEF DESCRIPTION OF THE DRAWINGS

FIG. 1 is a partially broken side view of the carton unfolding of the present invention;

FIG. 2 is a top view of the carton unfolding apparatus of the invention;

FIG. 10 is a view taken along lines 10—10 of FIG. 1.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Referring to FIGS. 1 and 2, a carton blank unfolding apparatus 1 is illustrated that includes the present invention. The carton unfolding apparatus finds particular usefulness for unfolding carton blanks having side flaps for side loading the opened cartons with complements of upright articles. However, it will be understood that the invention is not limited to unfolding side loading carton blanks.

Figure 9:
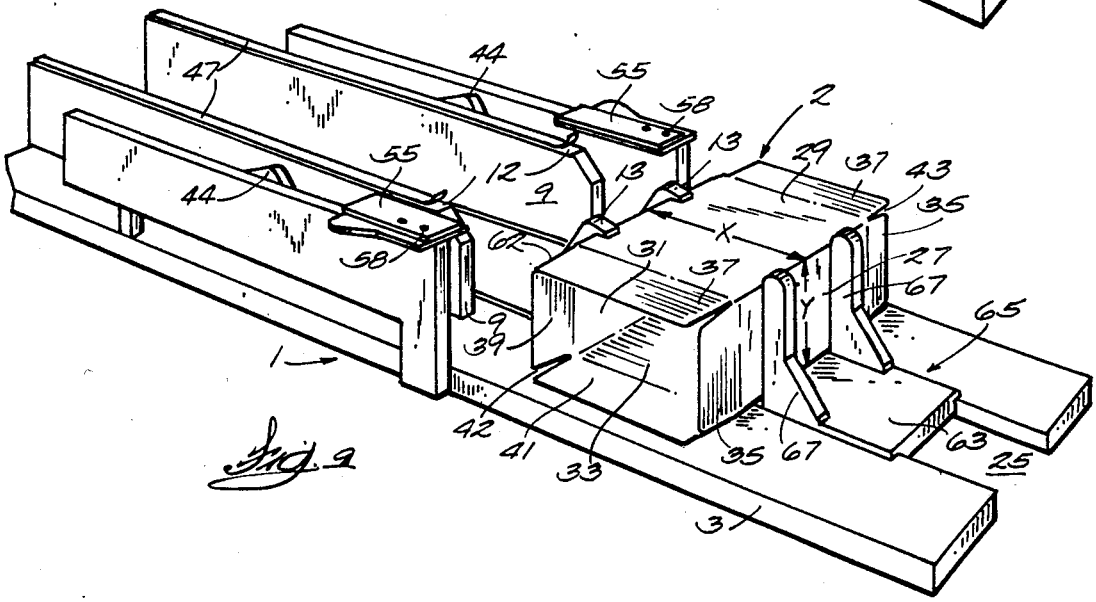
FIG. 9 is a perspective view of the completely unfolded carton blank between the stripper fingers and the carrier.

Referring to FIG. 9, a side loading carton 2 that is advantageously formed by the carton unfolding apparatus 1 will be described. The carton 2 consists of four interconnected sides, a front side 27, a top side 29, a back side 31, and a bottom side 33. The ends of the front, top, back, and bottom sides terminate in flaps 35, 37, 39, and 41, respectively. Front and back sides 27 and 31, respectively, are of equal length in the direction of dimension y, and top and bottom sides 29 and 33, respectively, are of equal length in dimension x. Dimension x is greater than dimension y. Adjacent flaps are separated by slits; for example, flaps 35 and 37 are separated by slits 43, and flaps 39 and 41 are separated by slits 42.

Figure 8:
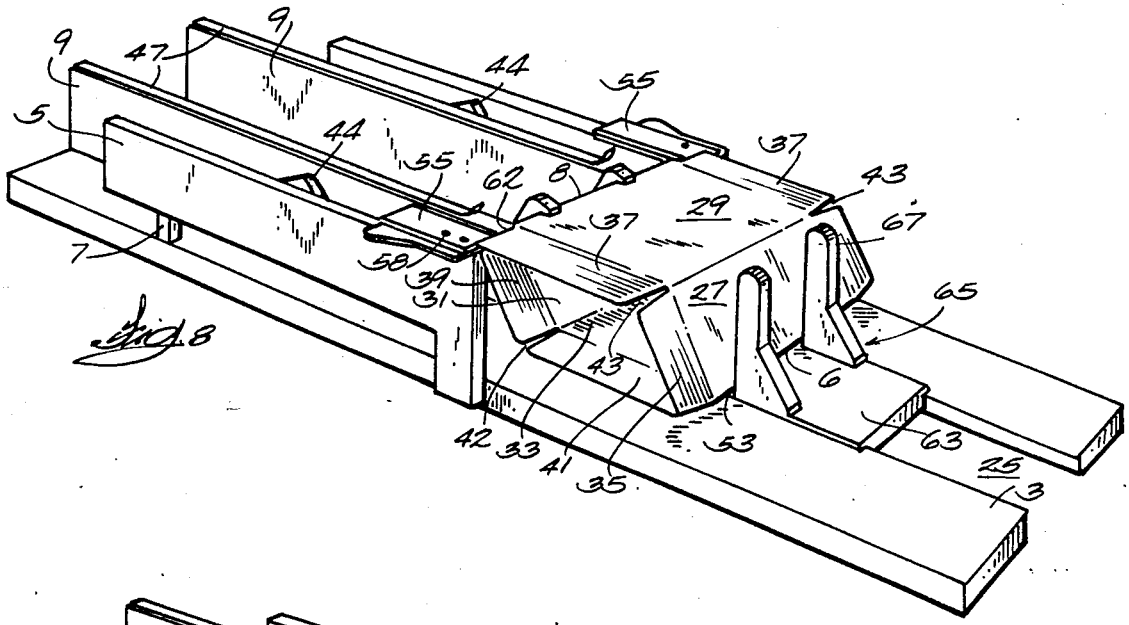
FIG. 8 is a perspective view showing the partially opened blank pressing beyond support engagement with the spring plates and showing the leading edge in contact with a carrier.

As shown in FIG. 1, the cartons 2 are supplied to the unfolding apparatus 1 in the form of folded carton blanks 4. The blanks 4 are folded such that the front side 27 and top side 29, with flaps 35 and 37, form an upper layer that is in facing contact with a lower layer consisting of back side 31 and bottom side 33 and flaps 39 and 41. Also see FIG. 8. Because dimension x, FIG. 9, of the top and bottom sides is not the same length as dimension y of the front and back sides, the slits 42 and 43 are not vertically aligned in the folded blank. Also see FIG. 7.

Referring to FIGS. 1, 2, and 10, the blanks 4 are supplied to supply station 24 of the unfolding apparatus 1 from a stack 26. Any suitable transfer means may be used to transfer the bottom blank of the stack 26 to the supply station 24. For example, the transfer means may include a pair of vacuum cups 34 that are reciprocated by a cam assembly 36 or an air cylinder, not shown. When activated, the vacuum cups 34 bow the lowest blank in the stack to enable a pair of stripper fingers 13 to engage the lowest blank and separate that blank from the stack as the stripper fingers move forwardly through the apparatus 1, which is from left to right with respect to FIGS. 1 and 2.

From the supply station 24, the blanks 4 move from left to right in the drawings in a downstream direction along an unfolding path through the unfolding apparatus 1. For convenience, the right edge 6 of a blank will be referred to as the leading edge, and the left edge 8 will be referred to as the trailing edge, FIG. 2. Flaps 35 and 41 will be referred to as leading flaps, and flaps 37 and 39 will be referred to as trailing flaps.

The unfolding apparatus 1 includes an elongated main frame diagramatically depicted at 3, FIGS. 1 and 2. The frame 3 includes a pair of laterally spaced longitudinally extending side plates 5 which are joined to the main frame by any suitable means, such as legs 7. Disposed between plates 5 are a pair of laterally spaced upstanding elongated support plates 9. The support plates 9 may be secured to the frame by any suitable means, such as welding. The upper surfaces 12 of the support plates support the blanks 4 received from the supply stack 26 at supply station 24 and downstream therefrom along a first section of the unfolding path. The upper right corners of the support plates are formed with large bevels 11.

To propel the blanks 4 from the supply station 24 through the unfolding apparatus 1, each pair of stripper fingers 13 is mounted to a movable plate 15. The plate 15 is attached to a block 16 and is moved from left to right by any suitable drive device, such as a pair of endless chains 17 driven through sprockets 19 by a conventional power mechanism, not shown. The upper ends of the stripper fingers 13 are fabricated as hooks 21, and the leading surfaces 23 are substantially vertical. The plates 15 may be supported by the frame 3 for sliding therealong in a slot 25.

Figure 3:
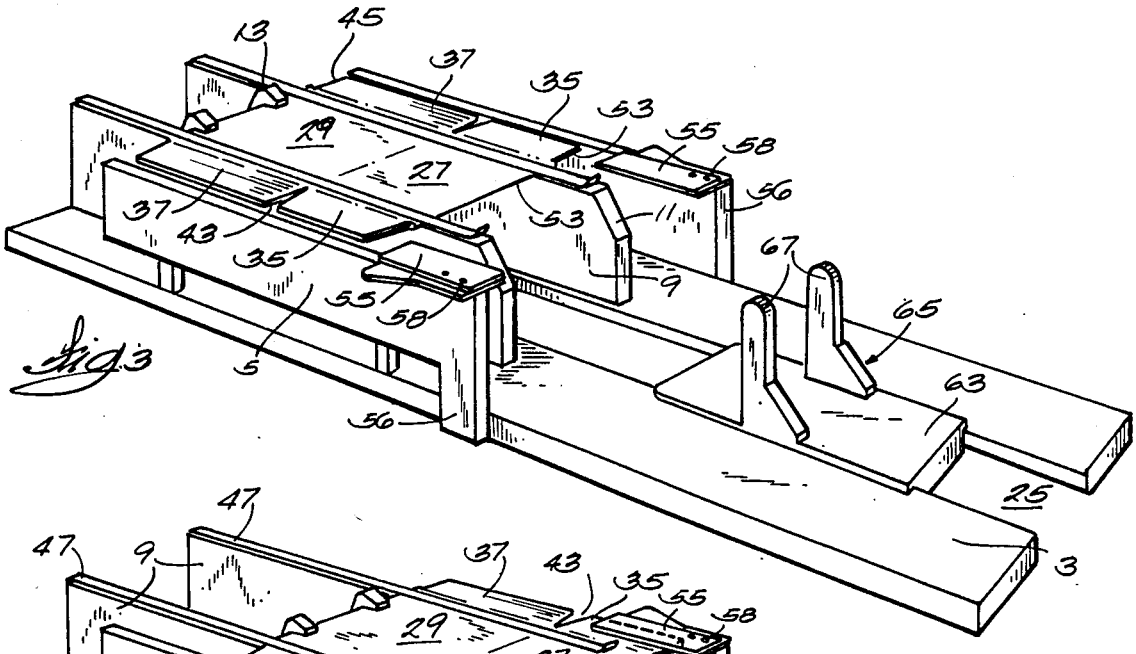
FIG. 3 is a perspective view of the carton unfolding apparatus folded carton blank at the supply sections at the start of the unfolding path.
Figure 4:
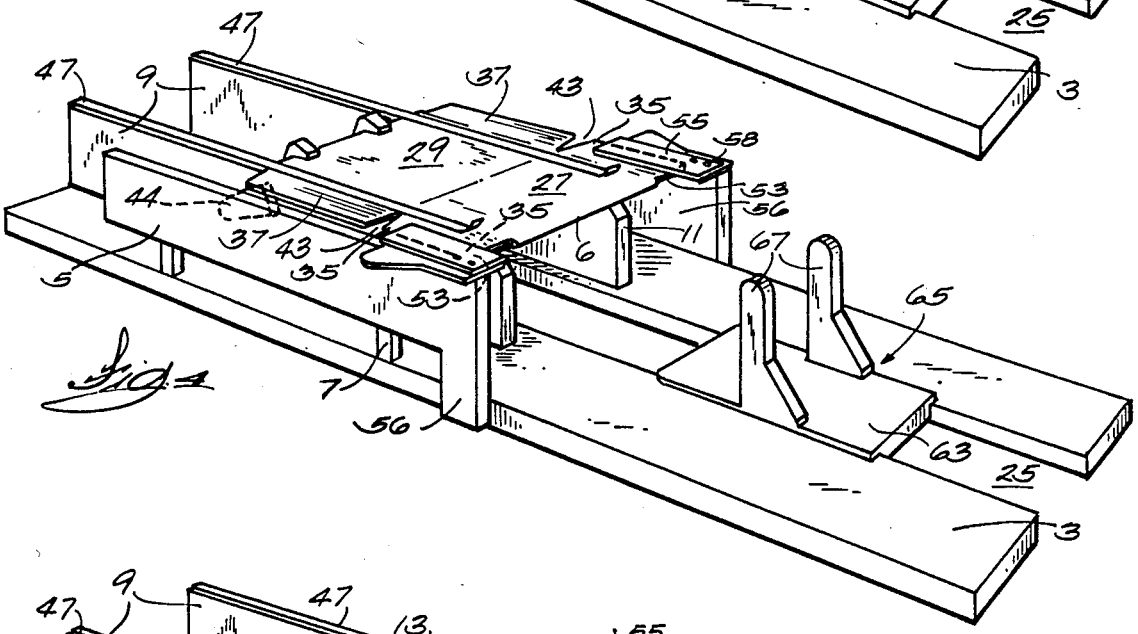
FIG. 4 is a perspective view showing the carton leading flaps passing under the cam controlled spring plates at the unfolding section.
Figure 5:
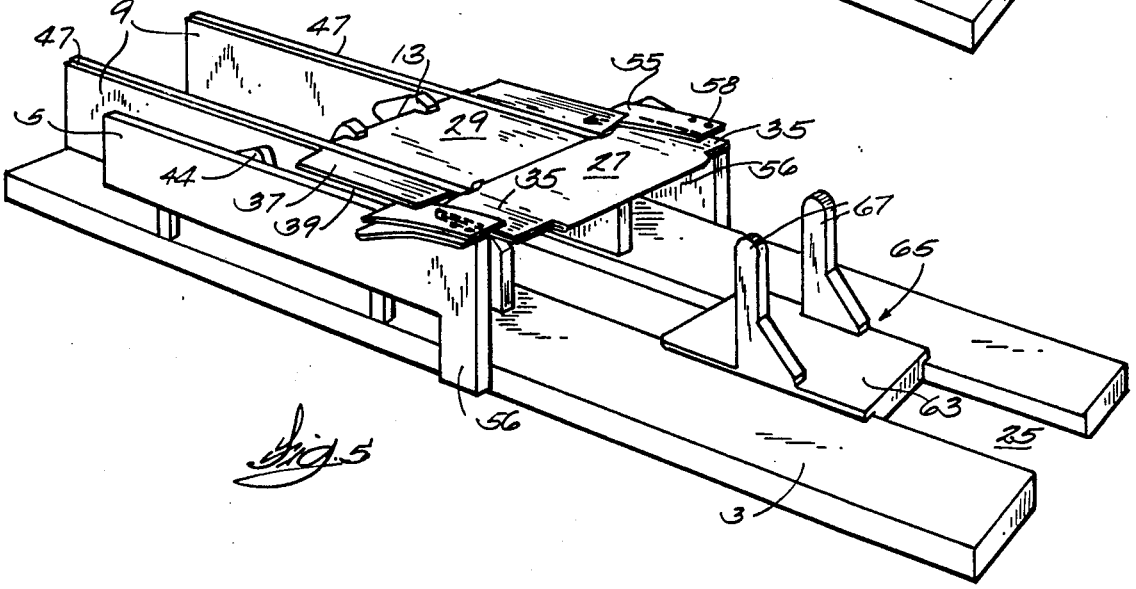
FIG. 5 is a perspective view showing the carton upper layer trailing flaps passing over the cam controlled spring plates which have been activated.
Figure 6:
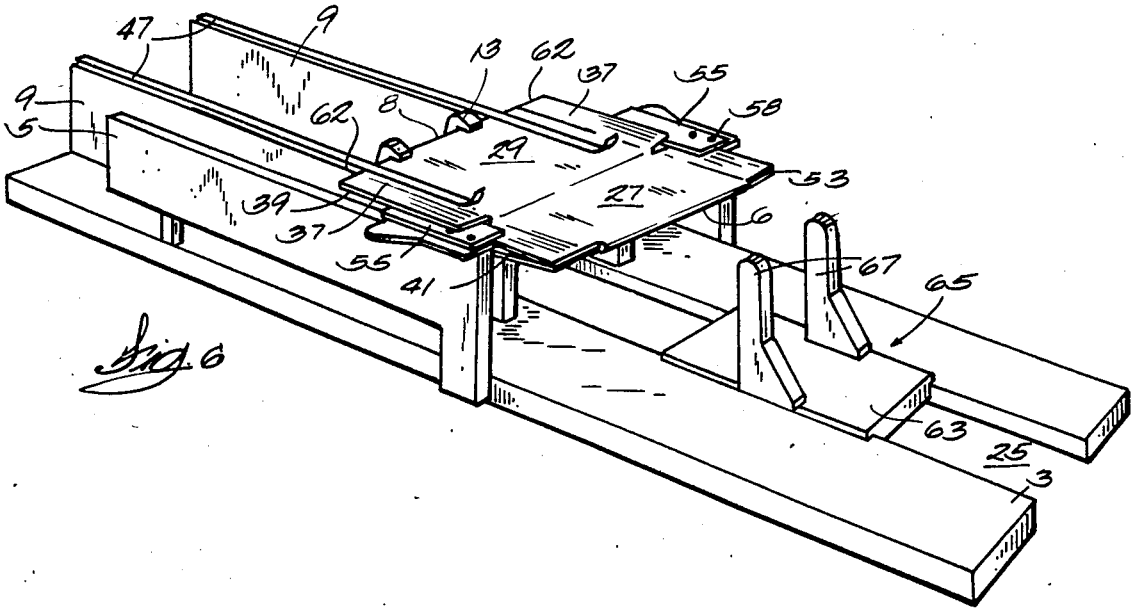
FIG. 6 is a perspective view showing the leading edge of the carton blank passing beyond support contact by the support plates.

Referring to FIGS. 2 and 3, the support plates 9 are transversely spaced such that the blank back and lower sides 31 and 33, respectively, contact and straddle the support plates, and the flaps 35, 37, 39, and 41 overhang the support plates. As the stripper fingers 13 propel the blank 4 downstream, the blank passes over a pair of assist blocks 44 that protrude a slight distance above the plane of the upper surfaces 12. The assist blocks 44 are located transversely relative to the support plates such that the free ends of the flaps pass thereover. Consequently, the flaps are raised above the surfaces 12. To ensure that the blank lower layer remains in contact with the surfaces 12, a pair of top guides in the form of transversely spaced elongated spring fingers 47 press against the blank upper layer. Each spring finger 47 is attached to the frame 3 by any suitable means, not illustrated herein. Thus, the flaps angle upwardly from the planes of the corresponding blank sides as the flaps pass over the assist blocks. As the stripper fingers propel the blank 4 farther downstream, the leading flaps, bottom flaps 41 and front flaps 35, pass beyond the assist blocks. As a result, the flaps 41 and 35 return to an attitude generally coplanar with the folded lower and upper sides, respectively. As the trailing flaps 37 and 39 pass over the assist blocks, they become angled upwardly relative to the planes of the carton sides and flaps 35 and 41. Consequently, a vertical gap is created in the slits 43 between the leading and trailing upper layer flaps 35 and 37, FIGS. 3 and 4. The substantially horizontal attitude of the leading flaps 35 and 41 permit their leading edges 53 to pass beneath cam controlled spring plates 55, FIG. 4. In the illustrated construction, the cam controlled spring plates 55 comprise flexible plates cantilever mounted at their downstream ends to upstanding blocks 56, as by fasteners 58. Each spring plate is adapted to enter the vertical gap in the slit 43 between the front flap 35 and top flap 37, FIGS. 4 and 5. To facilitate entry of the spring plates into the slits 43, the upstream edges of the spring plates may be deflected downwardly by suitable means, as, for example, the lobes of cams 57, FIGS. 1 and 2. The cams are mounted for rotation on shaft 59 in timed relationship to the forward movement of the stripper fingers 13. For clarity, the cams 57 and shaft 59 are not shown in FIGS. 3–9, but the deflected position of the spring plates is evident in FIG. 5. To accommodate the deflections of the spring plates, the side plates 5 are manufactured with triangular shaped notches 61, FIG. 1. Because the slits 42 and 43 are not aligned in the blank 4, the spring plates do not enter slits 42 between the bottom flaps 41 and the back flaps 39. See FIG. 8. Rather, the cams are rotated such that the spring plates have returned to a generally horizontal attitude as the slits 42 pass the upstream edges of the spring plates, and only the flaps 37 pass over the spring plates. See FIGS. 5, 6 and 7.

Figure 7:
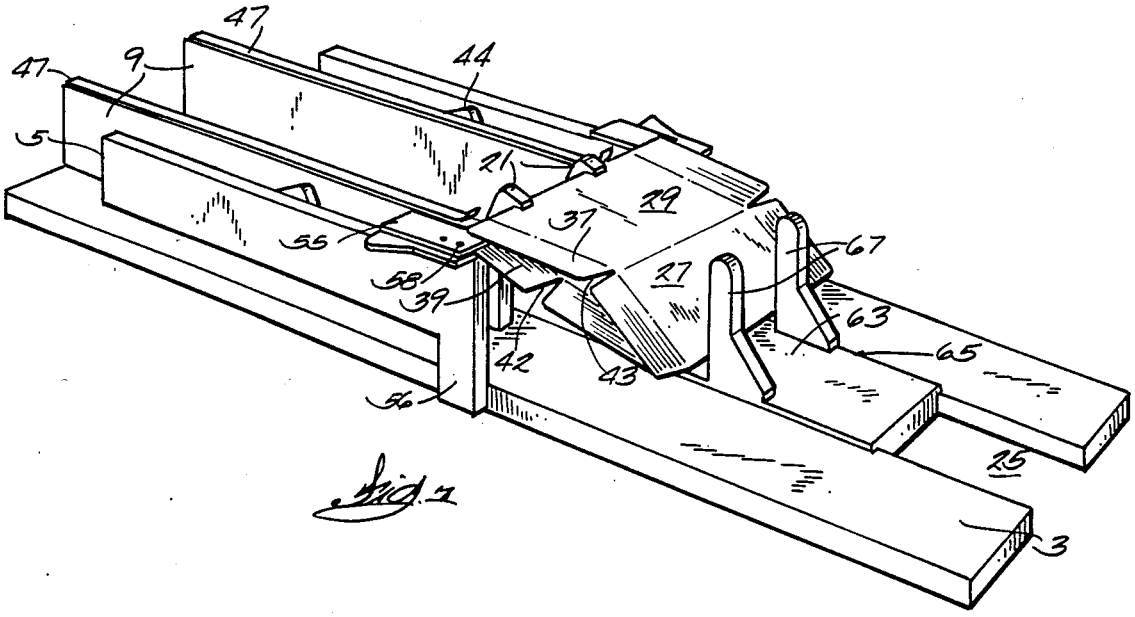
FIG. 7 is a perspective view showing the partially unfolded blank at a position at the unfolding section at which it is supported only by the spring plates and stripper fingers.

Returning to FIGS. 1, 3, and 4, it will be noticed that the bevels 11 of support plates 9 are located generally in line with the spring plates 55. The location of the bevels is chosen such that as the stripper fingers 13 propel the blank 4 to the right, the lower layer sides 31 and 33 loose support from the support plates as they pass under the spring plates, FIGS. 5 and 6. When the blank is at the location of FIG. 6, the cams 57 have rotated out of contact with the spring plates so that the spring plates have returned to their undeflected position underneath flaps 37 and over flaps 39. With continued motion from that point, the blank ultimately becomes supported upwardly only by the spring plates at the trailing edges 62 of the flaps 37. Consequently, the blank leading edge 6 tends to tip downwardly. Downward falling of the blank as a whole is prevented by hooks 21 restraining the blank trailing edge 8 from tilting upwardly, FIGS. 6 and 7. Since the bottom side 33 is unsupported by the support plates, it tends to fall by unfolding along the fold line associated with slits 42. Simultaneously, the back side 31, under the influence of the unsupported weight of the bottom side 33, tends to slide down the bevels 11. Additionally, a timed assist action, for example a cam similar to the cam 57 (FIG. 1) can be employed for positive positioning and control of the downward path of the leading edge of the blank until it strikes the base 63 of a carrier 65. As a result, the blank unfolds slightly, as seen in FIG. 7. Continued advancement by the stripper fingers pushes the flaps 37 completely past the spring plates to the location illustrated in FIG. 8. At that point, the leading edge 6 falls downwardly until it strikes the base 63 of the carrier 65.

The carrier 65 is adapted to move longitudinally within the slot 25 of frame 3. The carrier 65 is adapted to move longitudinally within the slot 25 of the frame 3 in timed relationship with the stripper fingers 13. For that purpose, the carrier is fastened to a take-off conveyor 66 that includes a pair of endless belts or chains 69 trained around sprockets 71, FIGS. 1 and 2. Sprockets 71 are driven through a shaft 73 by a conventional drive mechanism, not illustrated in FIG. 1. The carrier includes a pair of upstanding posts 67. It will be noticed in FIG. 8 that the movement of the carrier is timed in relation to the stripper fingers such that the carrier is located downstream of the spring plates 55 in a position to catch the leading edge 6 of the falling blank 4 in the corners between the posts 67 and base 63 just as the stripper fingers push the flap 37 trailing edges 62 off the spring plates. At that point, the partially unfolded blank is sloped downwardly in the downstream direction and is supported at the leading edge 6 by the carrier base and post and at the trailing edge 8 by the corners formed at the hooks 21 and vertical leading surfaces 23. In that attitude, the partially unfolded blank cannot collapse back into the folded configuration.

The take-off conveyor 66 moves the carrier 65 downstream at a speed that is slower than the speed of the stripper fingers 13. Consequently, the carton is forced into a completely opened position while it is being propelled downstream by the stripper fingers, FIG. 9. After the stripper fingers have pushed the blank to the fully opened condition, the take-off conveyor may be actuated to move the carrier further downstream at the same speed as the stripper fingers. Alternately, the carrier may be diverted out of the path of the stripper fingers by revolving about the downstream sprocket 71, not shown. In either case, the opened carton 2 is transported downstream until it reaches a loading station, at which complements of the desired numbers of upright articles are side loaded into the open side carton. The stripper fingers return to the location of FIGS. 1 and 2 by means of the chain and sprocket mechanism 17, 19 on a continuous basis. The carrier also returns to the location of FIGS. 1 and 2 by means of the take-off conveyor 66 in a manner that places the carrier at the proper location to cooperate with the stripper fingers and spring plates to unfold the blank as previously described.

Thus, it is apparent that there has been provided, in accordance with the invention, a carton unfolding apparatus that fully satisfies the aims and advantages set forth above. While the invention has been described in conjunction with specific embodiments thereof, it is evident that many alternatives, modification, and variations will be apparent to those skilled in the art in light of the foregoing description. Accordingly, it is intended to embrace all such alternatives, modification, and variations as fall within the spirit and broad scope of the appended claims.

I claim:

1. Apparatus for opening folded carbon blanks having sides and associated closure flaps extending from the ends thereof, the flaps of adjoining sides being separated by slits, the blanks being folded into an upper layer and a lower layer, each layer having two carton sides and associated flaps in facing contact with the sides and flaps of the other layer comprising:

a. an elongated frame;

b. stripper finger means translatably mounted to the frame for propelling a blank downstream along an opening path to thereby create leading and trailing edges and leading and trailing flaps in the blank;

c. support plate means mounted to the frame for supporting the blank lower layer sides at a first level along a first section of the opening path, the support plate means terminating at a second section of the opening path, the blank flaps overhanging the support plate means;

d. top guide means fixedly attached to the frame for maintaining contact between the blank lower layer sides and the support plate means;

e. spring plate means mounted to the frame at the second section of the opening path proximate the support plate means termination point for inserting between the blank trailing upper and lower flaps and for supporting the blank upper trailing flaps at the first level at the second section of the opening path as the blank leading edge is propelled past the support plate means by the stripper finger means and for cooperating with the stripper finger means to maintain the blank trailing edge at the first level at the second section while leaving the unsupported blank leading edge free to tip slightly downwardly by gravity to a second level lower than the first level to thereby impart an oblique orientation to the blank and to partially open the blank; and f. carrier means translatably mounted to the frame for stationarily receiving the leading edge of the angularly oriented and partially opened blank at the second level as the blank unsupported leading edge falls downwardly from the first to the second level when the stripper finger means propels the blank upper trailing flaps out of support contact with the spring plate means to permit continued downstream movement of the stripper finger means to open the blank into the opened condition.

2. The carton opening apparatus of claim 1 further comprising assist block means mounted to the frame at predetermined locations upstream of the spring plate means and in the paths of the blank flaps for raising the flaps passing thereover to an angle above the first level with respect to the flaps not passing thereover to thereby create vertical gaps between the raised and unraised flaps to thereby facilitate insertion of the spring plate means between the raised trailing flaps and the unraised leading flaps to separate the blank trailing upper and lower layer flaps and support the blank trailing upper flaps.

3. The opening apparatus of claim 2 wherein the stripper finger means includes hooks adapted to engage and overlay the blank trailing edge for propelling the blank along the opening path and for preventing the blank trailing edge from tipping upwardly above the first level when the unsupported blank leading edge tips downwardly by gravity at the second section and the blank trailing flaps trailing edges are supported by the spring plate means.

4. The opening apparatus of claim 3 wherein the support plate means comprises a pair of laterally spaced elongated upstanding plates having substantially co-planar top surfaces at the first section, and wherein the co-planar top surfaces terminate in beveled surfaces at the second section proximate the spring plate means, so that the blank sides are unsupported by the support plates at the second section when the blank upper trailing flaps are supported by the spring plate means and the stripper finger hooks prevent upward tipping of the blank trailing edge as the blank leading edge tips downwardly by gravity toward the second level to thereby permit the blank trailing lower side to slide down the support plate beveled surfaces to partially open the blank.

5. The opening apparatus of claim 4 wherein the top guide means comprises an elongated spring finger extending substantially continuously along the first section of each support plate and adapted to press against the blank upper layer as the blank is propelled along the opening path to thereby hold the blank sides against the upstanding plates as the blank flaps are propelled over and are raised by the assist block means.

6. The opening apparatus of claim 1 wherein the spring plate means comprises a pair of laterally spaced resilient plates having free upstream ends and downstream ends cantilever mounted to the frame and adapted to pass over the blank leading flaps and to enter the slits between the blank upper layer leading and trailing flaps to thereby pass under the trailing upper flap and over the trailing lower flap.

7. The opening apparatus of claim 6 wherein the spring plate means further comprises cam means mounted to the frame for resiliently deflecting the resilient plates free ends into the slits between the blank upper layer leading and trailing flaps in timed relationship to the translational motion of the stripper finger means to thereby enable the spring plates to support the blank upper layer trailing flaps at the second opening path section.

8. The opening apparatus of claim 1 wherein the carrier means comprises:

a. a base adapted for translational motion within the frame along the second level; and b. at least on upstanding post secured to the base, the post being located to receive the leading edge of the blank in the corner between the post and base as the blank leading edge falls downwardly from the first level to the second level as the stripper finger means propels the blank along the opening path past support contact with the support plate means and spring plate means, so that the partially opened blank is temporarily supported in a sloped attitude with the leading edge supported at the second level by the carrier means and with the trailing edge supported at the first level by the stripper finger means prior to being completely opened by continued motion of the stripper finger means relative to the carrier means.

9. A method of opening a folded carton blank having sides and associated closure flaps, the blank being folded into an upper layer and a lower layer, each layer having two sides and associated flaps, adjacent flaps having a slit therebetween comprising the steps of:

a. supporting the sides of the blank lower layer at a first level with a first support;

b. continuously propelling the supported blank in a downstream direction with the blank flaps projecting transversely to the direction of motion to create blank leading and trailing edges and leading and trailing sides with leading and trailing flaps flaps;

c. inserting a pair of laterally spaced second supports at the first level under the upper layer trailing flaps;

d. propelling the blank so that the leading sides and flaps move past support contact with the first support and the trailing upper flaps move into support contact with the second supports at the first level to permit the lower leading side to drop to partially open the blank and to permit the leading edge to tip by gravity downwardly to a second level lower than the first level to impart an oblique orientation to the blank;

e. propelling the blank upper trailing flaps past support contact with the second supports;

f. restraining the leading edge of the partially opened blank as it falls downwardly to the second level when the blank is propelled past support contact with the second supports; and g. propelling the partially opened angularly oriented blank trailing edge while restraining the leading edge to completely open the blank.

10. The method of claim 9 comprising the further step of raising the upper layer trailing flaps to an angled relationship with respect to the leading flaps to thereby create a vertical gap in the slits between the trailing and leading upper flaps prior to inserting the second supports under the upper trailing flaps to facilitate supporting the blank upper trailing flaps with the second support.

* * * * *

UNITED STATES PATENT AND TRADEMARK OFFICE

CERTIFICATE OF CORRECTION

PATENT NO. : 4,678,456

DATED : July 7, 1987

INVENTOR(S) : Biagio Nigrelli, Sr.

It is certified that error appears in the above—identified patent and that said Letters Patent is hereby corrected as shown below:

Column 6, Line 41 Delete "carbon" and substitute therefor ---carton---

Column 8, Line 31 Delete "blank" and substitute therefor ---blanks---

Signed and Sealed this

Second Day of February, 1988

*Attest:*

*Attesting Officer*

DONALD J. QUIGG

*Commissioner of Patents and Trademarks*